US006402297B1

(12) United States Patent
Yamaguchi

(10) Patent No.: US 6,402,297 B1
(45) Date of Patent: Jun. 11, 2002

(54) INKJET HEAD AND METHOD OF MANUFACTURING THE SAME

(75) Inventor: Takeshi Yamaguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/694,272

(22) Filed: Oct. 24, 2000

(30) Foreign Application Priority Data

Oct. 25, 1999 (JP) ..... 11-302502

(51) Int. Cl.[7] ..... B41J 2/145; B41J 2/15; B41J 2/05

(52) U.S. Cl. ..... 347/40; 347/58

(58) Field of Search ..... 347/40, 58, 59, 347/66, 85

(56) References Cited

U.S. PATENT DOCUMENTS 5,606,352 A * 2/1997 Yamakawa et al. ..... 347/20

6,302,530 B1 * 10/2001 Shimada et al. ..... 347/86

* cited by examiner

*Primary Examiner*—Thinh Nguyen
(74) *Attorney, Agent, or Firm*—Fitzpatrick, Cella, Harper & Scinto

(57) ABSTRACT

In an inkjet head acting as a liquid ejecting head for carrying out a print operation by ejecting liquids onto a medium to be recorded, the inkjet head including two rows of orifice arrays, which are disposed approximately parallel with each other and a group of supply ports for feeding the liquids to the orifice arrays, the orifice arrays and the supply ports being arranged integrally, and only one of the two rows of the orifice arrays being used, a dummy heater board having the same shape as that of a heater board is caused to come into intimate contact with an unused side liquid chamber. Further, ribs are disposed in the vicinity of an unused side ink path so as to increase strength. With this arrangements, an intimate contact property can improved, irregular print can be eliminated and the disposition of orifice arrays on a top plate as a single isolated member can be reproduced even at the time the inkjet head is completed.

3 Claims, 7 Drawing Sheets

INKJET HEAD AND METHOD OF MANUFACTURING THE SAME

BACKGROUND OF THE INVENTION

1. Field of the Invention

The present invention relates to an inkjet head used in an inkjet recording apparatus and to a method of manufacturing the inkjet head.

2. Description of the Related Art

Hitherto, employed as an energy generating element for an inkjet recording apparatus are an energy generating element using an electro-mechanical transducer such as a piezo element or the like, an energy generating element heated by an electromagnetic wave such as laser irradiated thereto for ejecting droplets of ink by the action of heat, an energy generating element for heating liquid by an electro-thermal transducer having a heat generating resistance member, and the like.

In the inkjet recording apparatus, there is known an inkjet head for performing print by ejecting a plurality of different types of liquids through two rows of an orifice array so as to cope with a requirement for high image quality and high speed printing. There is also known an inkjet head which utilizes only one of two rows of orifice arrays when photo ink is not necessary in a graph and the like.

In FIG. 7, reference numeral 1 denotes a top plate on which a liquid flow path groove liquid chamber and orifice arrays are disposed, reference numeral 2 denotes a wiring substrate for electrically connecting a heater board having a resistance heating element mounted thereon to a carriage, reference numeral 3 denotes an elastic body for pressing and fixing the heater board against and to the top plate 1, reference numeral 24 denotes a color orifice array drilled through the top plate 1 for ejecting color inks (Y, M, C), respectively, and reference numeral 25 denotes an elastic member for improving the intimate contact between the heater board and the top plate 1.

In the above inkjet head, the top plate of a photo head is constructed similarly to that of a color head and a head assembling device can be commonly used, which permits the inkjet head to be made without the provision of a new device.

In the color head of the above conventional example, the heater board is pressed against the top plate only on one side thereof through the elastic body, the disposition of the orifice array, when an inkjet head is completed, may be different from the disposition thereof when the top plate is completed.

Further, when the heater board is coupled with the top plate and when the elastic member is inserted, an unused side ink flow path is moved, from which arises a problem that the intimate contact of a used side heater board with a liquid flow path groove is made bad and characters are irregularly printed.

SUMMARY OF THE INVENTION

Accordingly, it is an object of the present invention to provide an inkjet head, in which a dummy board having the same shape as that of a heater board is disposed in an intimate contact state and a rib is disposed in the vicinity of an unused side ink feed path to increase strength, so as to improve an intimate contact property, to eliminate irregular print and to reproduce the disposition of orifice arrays on a top plate as a single isolated member even at the time an inkjet head is completed, and to provide a method of manufacturing the inkjet head.

To solve the above problem, the present invention provides an inkjet head arranged as shown in the following items (1) and (2) and a method of manufacturing the inkjet head.

(1) In an inkjet head acting as a liquid ejecting head for carrying out a print operation by ejecting liquids onto a medium to be recorded, the inkjet head including two rows of orifice arrays, which are disposed approximately parallel with each other and a group of supply ports for feeding the liquids to the orifice arrays, the orifice arrays and the supply ports being arranged integrally, and only one of the two rows of the orifice arrays being used, the inkjet head is characterized in that a dummy heater board having the same shape as that of a heater board is caused to come into intimate contact with an unused side liquid chamber.

(2) In an inkjet head acting as a liquid ejecting head for carrying out a print operation by ejecting liquids onto a medium to be recorded, the inkjet head including two rows of orifice arrays, which are disposed approximately parallel with each other and a group of supply ports for feeding the liquids to the orifice arrays, the orifice arrays and the supply ports being arranged integrally, and only one of the two rows of the orifice arrays being used, the inkjet head is characterized in that ribs are disposed in the vicinity of an unused side ink path so as to increase strength.

(3) A method of manufacturing of an inkjet head in which two boards are jointed to each other through an elastic member at positions which are symmetrical with respect to a top plate member including a plurality of orifices for ejecting inks and a supply port for feeding inks to the array of the plurality of orifices and a flow path is formed so as to communicate with the orifices, the inkjet head using only one of the two boards for ejecting inks includes the steps of pressing and fixing the board used for ejecting inks against and to the top plate by an elastic member; and pressing and fixing a board, which is not used to eject inks, against and to the top plate to which the board used to eject inks has been fixed.

Further objects, features and advantages of the present invention will become apparent from the following description of the preferred embodiments with reference to the attached drawings.

DESCRIPTION OF THE PREFERRED EMBODIMENTS

With the arrangement of the present invention, it is possible to cause a dummy board having the same shape as that of a heater board to come into intimate contact with an unused side orifice array and to increase the strength of the heater board by the provision of a rib in the vicinity of the ink path of the unused side orifice array, thereby improving the intimate contact of the heater board, eliminating irregular print, and reproducing the disposition of orifice arrays realized on a top plate as a single isolated member even at the time an inkjet head unit is completed. Further, a heater board, which is used to eject ink, is jointed to the top plate first, which improves the quality of printed characters and enhances productivity. Embodiments Embodiments of the present invention will be described below.

Embodiment 1

Figure 4:
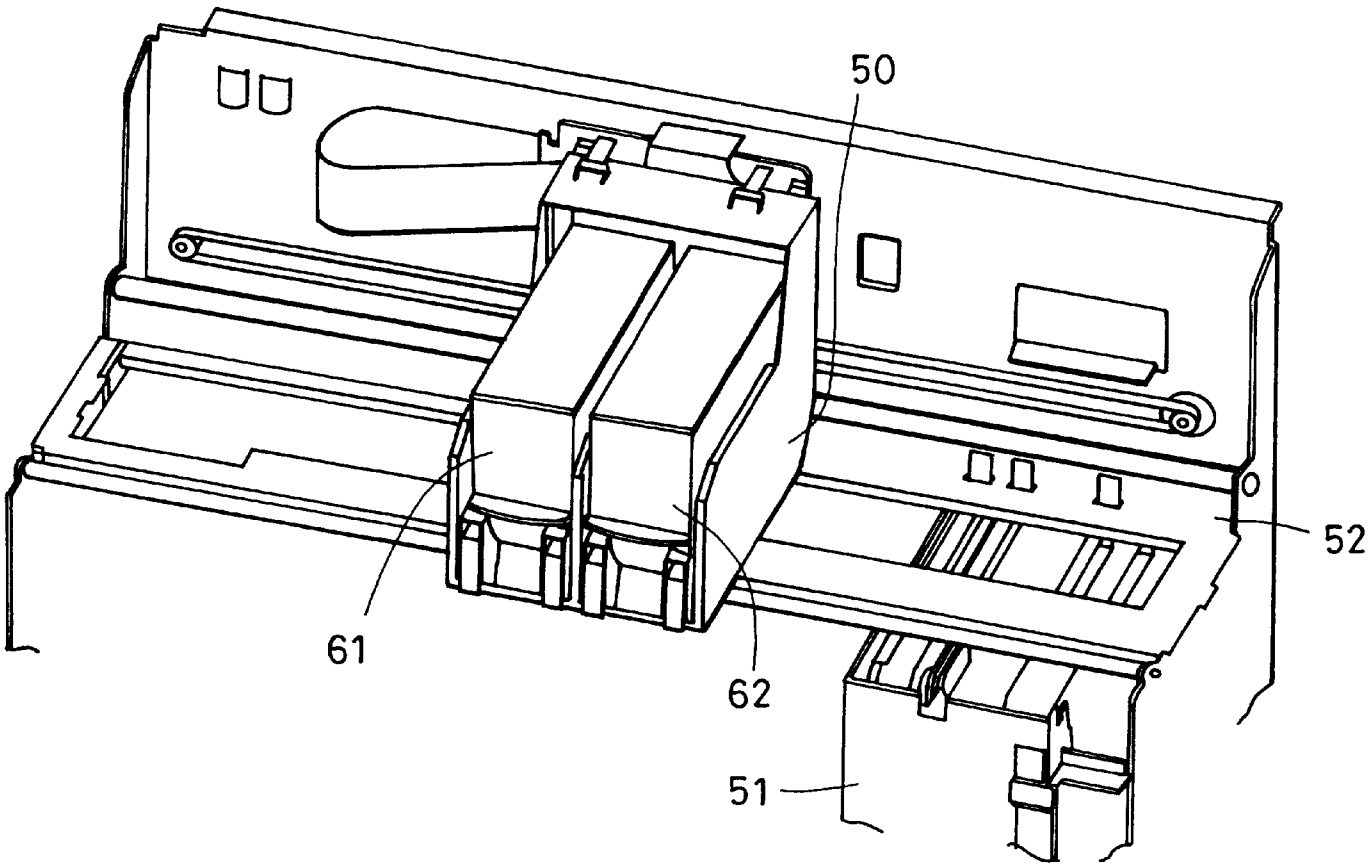
FIG. 4 is an outside perspective view showing an example of an inkjet printer on which inkjet head cartridges obtained by the present invention are mounted.

FIG. 4 shows the arrangement of an embodiment 1 according to the present invention by means of the outside appearance of an example of an inkjet head together with an inkjet printer to which the inkjet head is applied.

In FIG. 4, reference numeral 50 denotes a carriage on which a recording head is mounted, and reference numeral 51 denotes a head recovery unit in which a head cap and a suction pump are assembled. The head recovery unit 51 prevents the ink ejected from a plurality of orifices formed at the extreme end of the inkjet head from being dried. The suction pump draws ink from the plurality of orifices when the malfunction of the inkjet head occurs. Reference numeral 52 denotes a sheet feed surface on which a recording sheet is transferred.

A black ink cartridge 61 and a color ink cartridge 62 are mounted on the carriage 50 laterally side by side. The carriage 50 has a home position located on the head recovery unit 51, and a print operation is started when the carriage begins scanning in a left direction in the figure.

Figure 5:
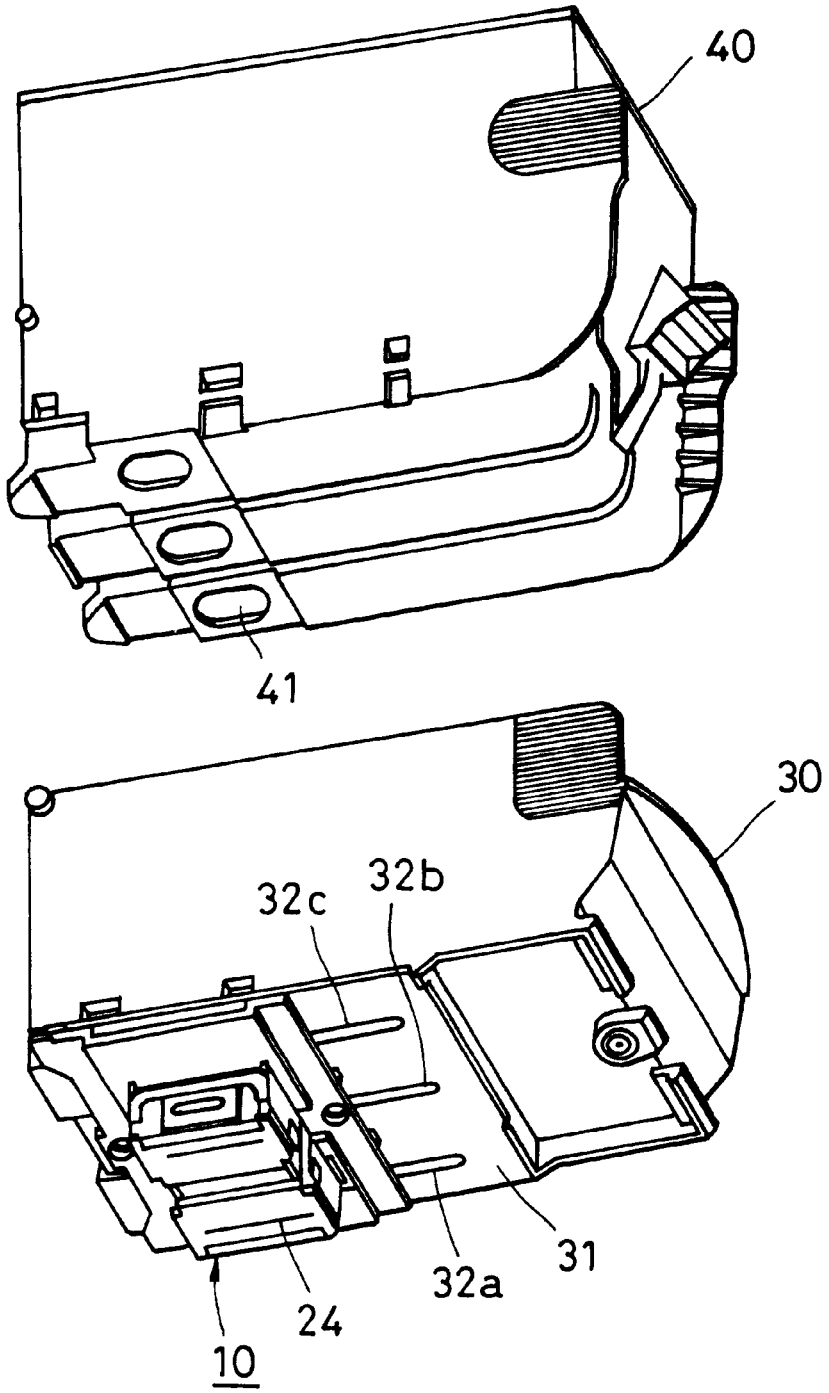
FIG. 5 is a perspective view showing a holder, which has the inkjet head units of the present invention disposed on the bottom thereof, and an ink tank.

FIG. 5 is a perspective view of a holder 30 which constitutes the inkjet head of the present invention and an ink tank 40. The holder 30 includes a plurality of inkjet head units 10 each having an ink ejector and disposed on the bottom thereof, and the ink tank 40 is mounted on the holder 30. The inkjet head units 10 are connected to the ink tank 40 through the holder 30 as well as the ink tank 40 is held thereby.

Each inkjet head unit 10 of the embodiment can be used as a photo head when a photo color ink orifice 23, which faces a color ink orifice array 24, is provided with an ink ejecting function. With this arrangement, almost all top plates acting as a board for a photo head and a color head can be commonly used, and a head assembling device can be also commonly used, which permits the inkjet head to be made without providing a new device.

The holder 30 has a flow path forming member 31 disposed on the bottom thereof. Flow paths 32*a,* 32*b* and 32*c* are formed in the flow path forming member 31 to introduce inks to the ink ejectors of the inkjet head units 10. It is preferable that the flow path forming member 31 be formed of a transparent material so that the state of inks, such as the inks introduced to the inkjet head units 10 through the flow paths 32*a,* 32*b* and 32*c* formed in the flow path forming member 31 and the inks in which bubbles are mixed, can be visually observed so as to confirm that the inks have been spent in the ink tank 40 by the bubbles mixed with the inks. Thus, the flow path forming member 31 is formed of the transparent material.

The ink tank 40 is formed so as to be mounted on the holder 30 and has supply ports 41 formed on the bottom thereof which are as many as the number of the inkjet head units of the holder 30, that is, three pieces in the embodiment. Yellow ink, magenta ink and cyan ink, for example, are stored separately in the liquid tank 40.

Figure 1:
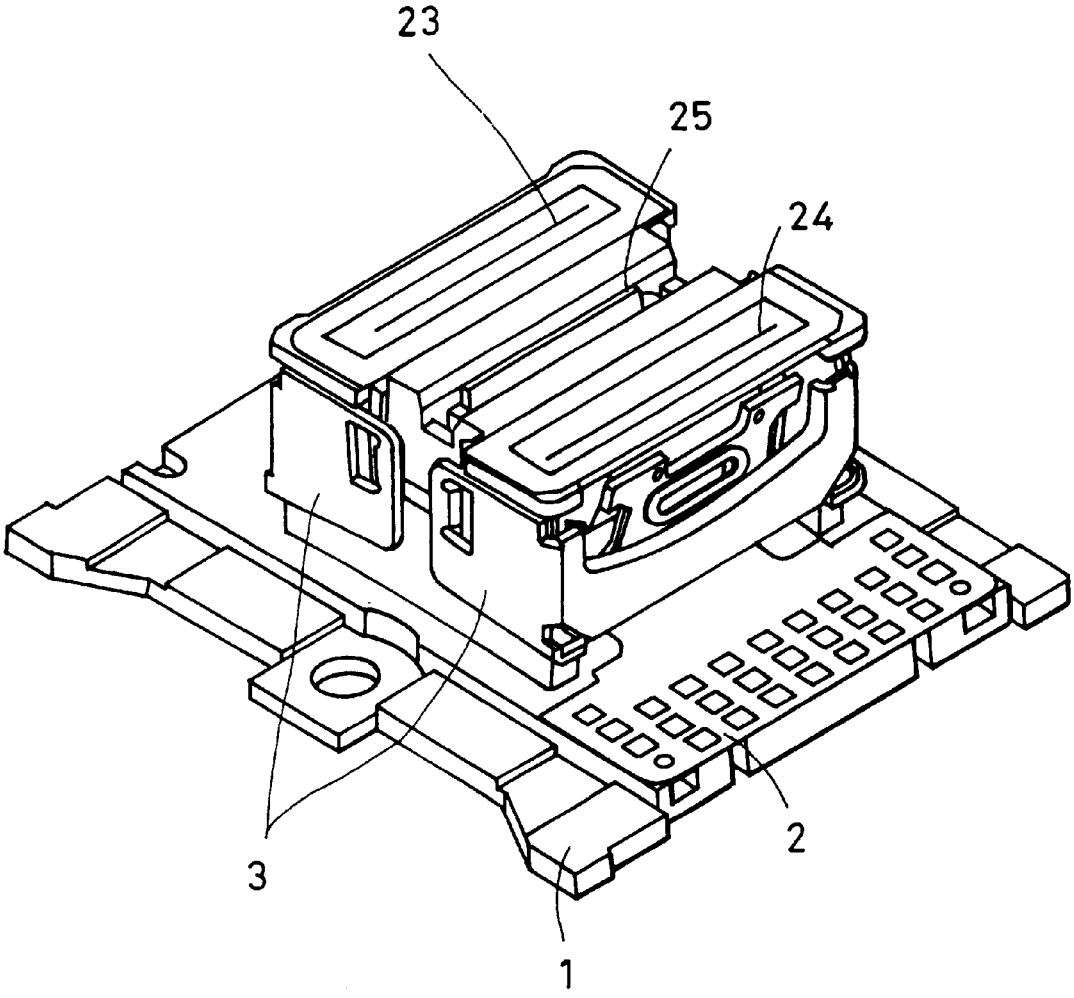
FIG. 1 is a perspective view showing the arrangement of an inkjet head of a first embodiment of the present invention.

FIG. 1 is a view explaining the inkjet head in detail.

In FIG. 1, reference numeral 1 denotes a top plate on which a liquid flow path groove liquid chamber and orifice arrays are disposed, reference numeral 2 denotes a wiring substrate for electrically connecting a heater board 4, which has a resistance heating element mounted thereon, to a carriage, reference numeral 3 denotes an elastic body for pressing and fixing the heater board 4 against and to the top plate 1, reference numeral 24 denotes a color orifice array drilled through the top plate 1 for ejecting color inks (Y, M, C), respectively, and reference numeral 25 denotes a V-shaped elastic member for improving the intimate contact between nozzles and the heater board 4.

Figure 2:
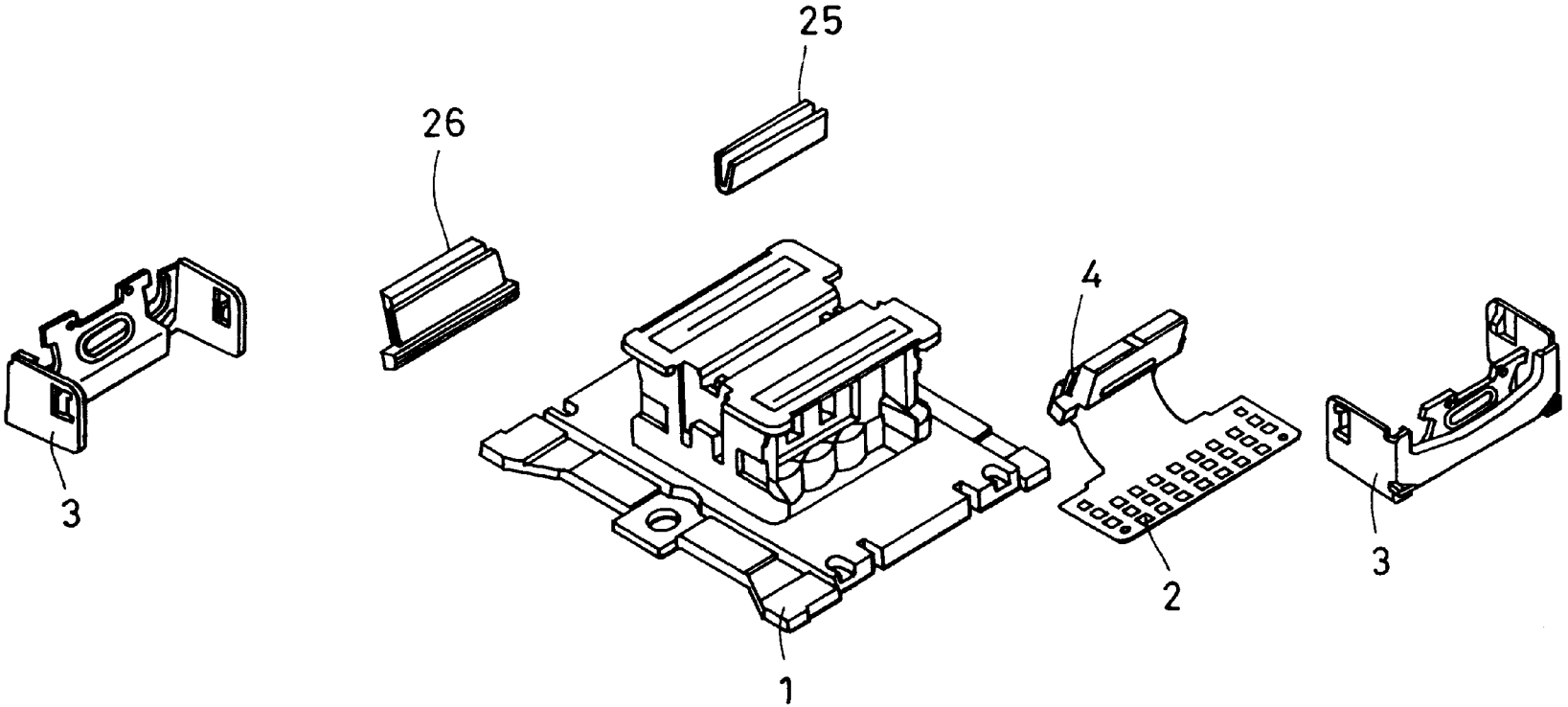
FIG. 2 is a perspective view schematically showing the arrangement of the inkjet head shown in FIG. 1.

FIG. 2 is an exploded perspective view showing the detailed arrangement of the inkjet head units 10 shown in FIG. 1 in which how parts are arranged and assembled is schematically drawn so as to be easily understood. In FIG. 2, reference numeral 4 denotes the heater board including the above resistance heating element and the wiring substrate 2 is electrically connected by TAB (tape automated bonding). Reference numeral 26 denotes a dummy heater board coming into intimate contact with an unused side liquid chamber. The dummy heater board 26 has the same shape as that of the heater board 4 and composed of resin. Otherwise, the dummy heater board 26 may be a failed heater board.

It should be noted that, in the embodiment, the heater board 4 is mounted on the top plate 1 and thereafter the dummy heater board 26 is attached thereto. With this arrangement, the heater board 4 can be aligned in the state that top plate 1 does not receive an elastic force from the dummy heater board 26 so that the heater board 4 can be aligned more accurately. Further, the alignment accuracy of the dummy heater board 26 need not be so high as the heater board 4, productivity being improved thereby.

Figure 3:
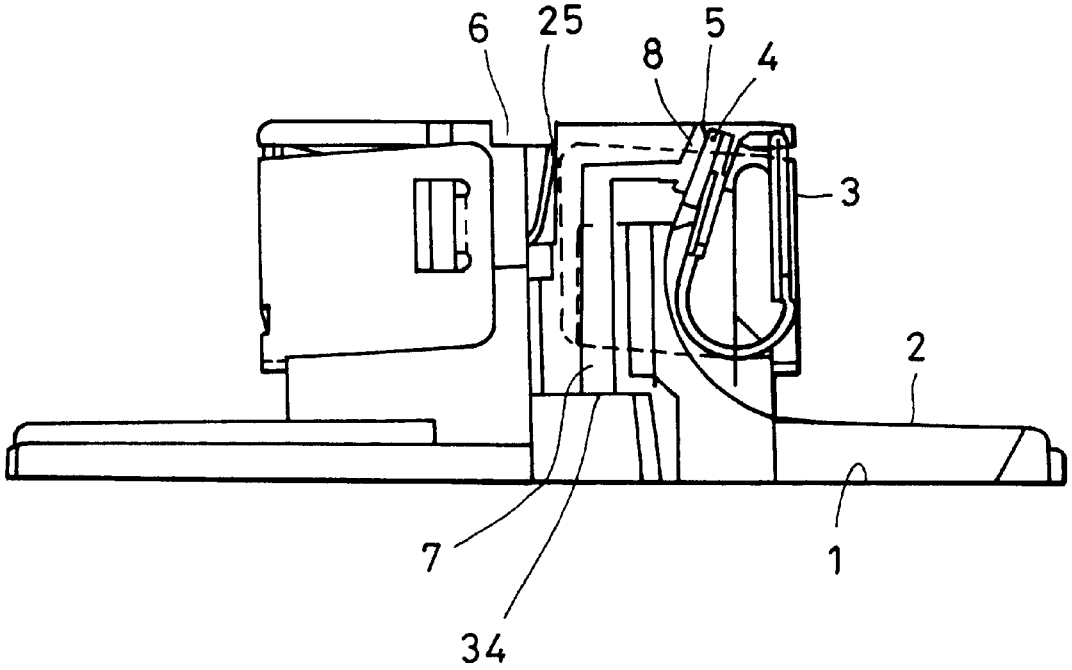
FIG. 3 is a sectional view of the inkjet head shown in FIG. 1 which is drawn so that the outline of the inner arrangement and the liquid path thereof can be easily understood.

Further, FIG. 3 is a sectional view of the inkjet head 10 shown in FIG. 1 which is drawn so that the outline of the inner arrangement and the ink path thereof can be easily understood. In FIG. 3, reference numeral 7 denotes a liquid introduction path for introducing an ink from an ink vessel to a liquid chamber 8. The ink passes through the liquid introduction path 7 via an ink supply port 34, enters the liquid chamber 8 formed by the top plate 1 and the heater board 4, and further inters a liquid path of the heater board from the liquid chamber 8. Then, the ink is ejected from discharge ports 5 by the film boiling produced by the heat energy of the heating element.

The liquid chamber 8 is formed by the top plate 1 and the heater board 4, and after the heater board 4 is pressed against the top plate 1 by the elastic body 3, the gap between the top plate 1 and the heater board 4 is perfectly sealed with a seal member so as to prevent the leakage of ink from the gap.

The top plate 1 is an integrally molded member, and the color ink orifice array 24, the liquid flow path grooves, a liquid chamber frame and the liquid introduction path 7 are molded or processed with laser beams.

The color orifice array 24 and the liquid flow path grooves must be processed with pinpoint accuracy. Further, a material constituting the integrally molded member must be selected from materials which are not attacked by ink. While polyolefine is preferably used as a specific material, other materials may also be used.

Embodiment 2

An embodiment 2 of the inkjet head of the present invention will be described with reference to FIG. 6.

Figure 6:
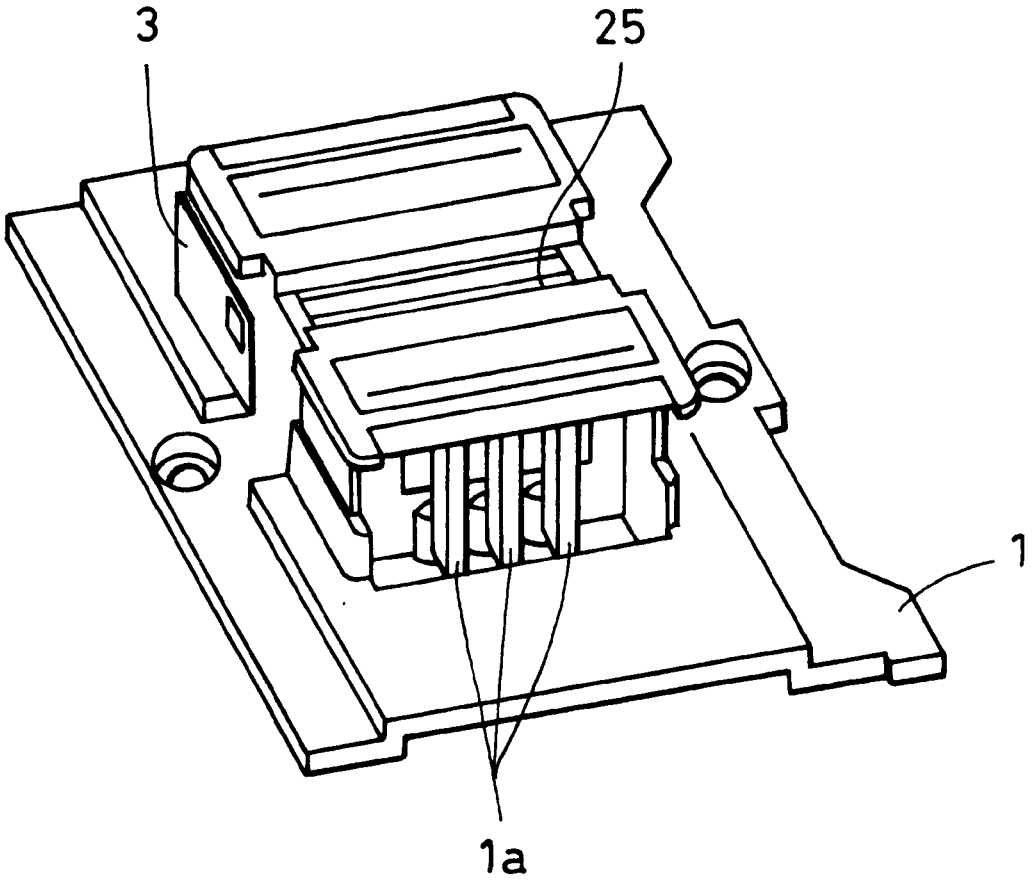
FIG. 6 is a perspective view showing the arrangement of a second embodiment of the inkjet head of the present invention.
Figure 7:
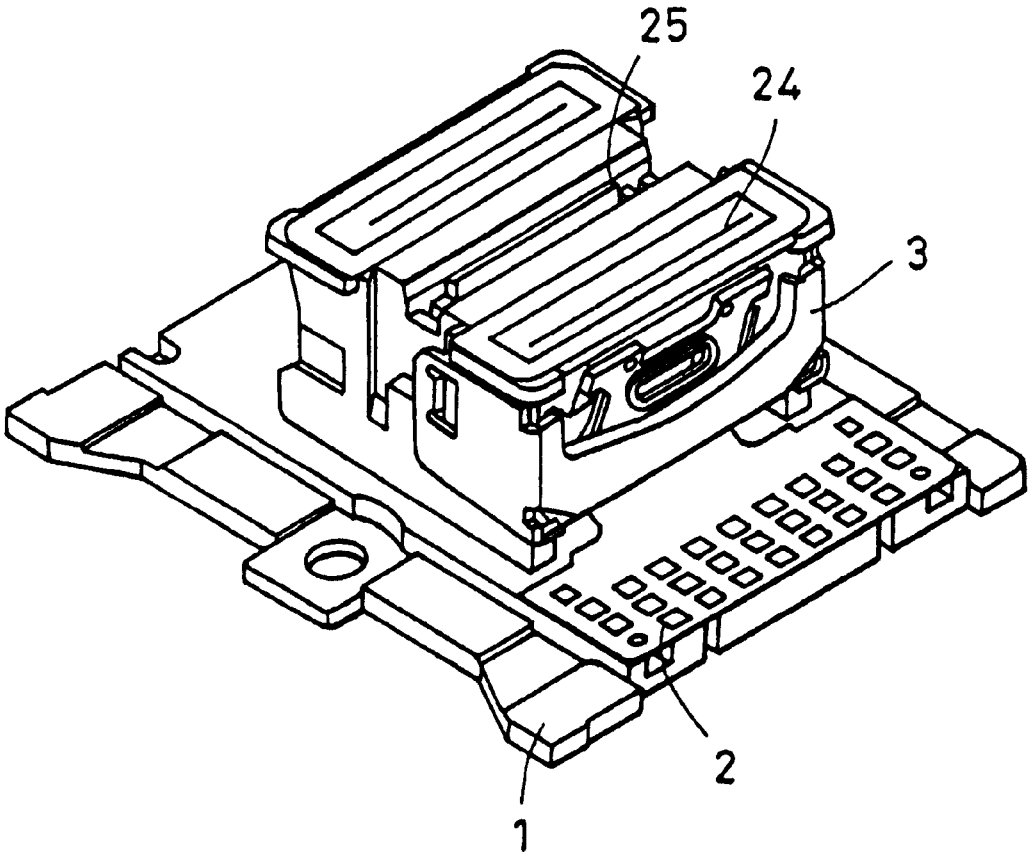
FIG. 7 PRIOR ART
FIG. 7 is a perspective view showing a conventional example.

In FIG. 6, what is different from the embodiment 1 is a shape of a top plate on an unused side.

Reference numeral 1*a* denotes reinforcing ribs for suppressing the movement of the unused side portion of a top plate when an elastic member is inserted. The embodiment 2 can be embodied only by changing sliding units of a metal mold without increasing the number of parts.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An inkjet head acting as a liquid ejecting head for carrying out a print operation by ejecting liquid onto a medium to be recorded, comprising:

two rows of orifice arrays, disposed approximately parallel to each other, only one of said two rows of orifice arrays being used to eject liquid; and a group of supply ports for feeding the liquid to said orifice arrays, wherein said orifice arrays and said supply ports are arranged integrally, and a dummy heater board having the same shape as that of a heater board is caused to come into intimate contact with a liquid chamber disposed on a side of said inkjet head having the row of orifice arrays that is not used to eject liquid.

2. An inkjet head acting as a liquid ejecting head for carrying out a print operation by ejecting liquid onto a medium to be recorded, comprising:

two rows of orifice arrays, disposed approximately parallel to each other, only one of said two rows of orifice arrays being used to eject liquid; and a group of supply ports for feeding the liquid to said orifice arrays, wherein said orifice arrays and said supply ports are arranged integrally, and reinforcing ribs are disposed in the vicinity of an ink path disposed on a side of said inkjet head having the row of orifice arrays that is not used to eject liquid.

3. A method for manufacturing an inkjet head, said inkjet head comprising:

a plurality of orifices for ejecting ink, a supply port for feeding ink to said plurality of orifices, and a flow path for communicating ink from said supply port to said orifices, wherein two boards are joined to each other by an elastic member at positions which are symmetrical with respect to a top plate member, and said inkjet head uses only one of said two boards for ejecting ink, said method comprising the steps of:

pressing and fixing said board used for ejecting ink against and to said top plate member by means of said elastic member; and pressing and fixing said board which is not used for ejecting ink against and to said top plate member, to which said board used for ejecting ink has been fixed.

* * * * *